US006177230B1

(12) United States Patent
Kawamura

(10) Patent No.: US 6,177,230 B1
(45) Date of Patent: Jan. 23, 2001

(54) HEAT-HARDENABLE COMPOSITION AND PLANOGRAPHIC FORM PLATE USING THE COMPOSITION

(75) Inventor: Koichi Kawamura, Shizuoka-ken (JP)

(73) Assignee: Fuji Photo Film Co., Ltd., Minami-Ashigara (JP)

( * ) Notice: Under 35 U.S.C. 154(b), the term of this patent shall be extended for 0 days.

(21) Appl. No.: 09/289,671

(22) Filed: Apr. 12, 1999

(30) Foreign Application Priority Data

Apr. 13, 1998 (JP) ..... 10-101578

(51) Int. Cl.[7] ..... G03C 1/72
(52) U.S. Cl. ..... 430/270.1
(58) Field of Search ..... 430/270.1

(56) References Cited

U.S. PATENT DOCUMENTS 6,004,724 * 12/1999 Yamato et al. ..... 430/281.1
6,017,675 * 1/2000 Dietliker et al. ..... 430/270.1
6,096,479 * 8/2000 Kawamura et al. ..... 430/270.1

FOREIGN PATENT DOCUMENTS 0 855 267 7/1998 (EP) .
0 922 570 6/1999 (EP) .
2 203 438 10/1988 (GB) .

* cited by examiner

*Primary Examiner*—Janet Baxter
*Assistant Examiner*—Barbara Gilliam

(74) *Attorney, Agent, or Firm*—Burns, Doane, Swecker & Mathis, LLP

(57) ABSTRACT

The heat-hardenable composition of the present invention comprises a compound having two or more sulfonic acid ester groups each capable of releasing sulfonic acid by the action of heat. Further, the composition may comprise a compound having two or more groups each reactive with the group generated by the thermal release of sulfonic acid. Still further, the composition may comprise a compound which has two or more sulfonic acid ester groups each capable of releasing sulfonic acid by the action of heat and which has two or more groups each reactive with the group generated by the thermal release of sulfonic acid. The compound having two or more sulfonic acid ester groups each capable of releasing sulfonic acid by the action of heat may contain the structure represented by the following general formula (1):

General formula (1)

where L represents an organic group comprising polyvalent non-metallic atoms which is necessary for linking the structure represented by the general formula (1) to a polymer skeleton; and $R^1$ and $R^2$ each represent a substituted or unsubstituted alkyl group or otherwise a substituted or unsubstituted aryl group.

18 Claims, No Drawings

HEAT-HARDENABLE COMPOSITION AND PLANOGRAPHIC FORM PLATE USING THE COMPOSITION

BACKGROUND OF THE INVENTION

1. Field of the Invention

The present invention relates to a heat-hardenable composition, a heat-sensitive recording material and a planographic form plate using the composition. More specifically, the present invention relates to a heat-hardenable composition having excellent storage stability and hardenability, a heat-sensitive recording material utilizing the thermally cross-linkable property of the composition, particularly a heat-sensitive recording material capable of being used as a material for a planographic printing plate in a direct plate making process in which the material is directly inscribed by scanning an infrared laser, and a planographic form plate using the heat-sensitive recording material.

2. Description of the Related Art

Traditionally, the technology of a heat-hardenable resin, which can be cross-linked by the action of heat, is so versatile that it has been used in a variety of applications including the production of paints, ink, rubber, adhesives, and the like, textile processing in the field of textile materials, the production of sealing materials in the field of electronics related materials, and printing and resist production. As to materials for the traditional heat-hardenable resins and their application in ink, rubber, and adhesives, details are described in a number of textbooks. An example of the textbooks is "Handbook of cross-linking agents", edited by S. Yamashita et al, Taiseisha Publishing Co., Ltd. (1981). Application of a heat-hardenable resin in printing is described in, for example, Japanese Patent Application Publication (JP-B) No. 45-23,519.

As to the application to photosensitive recording materials, solid-state and semiconductor lasers, which emit infrared light of wavelengths range from 760 to 1200 nm, are recently attracting attention as a recording light source in a system where plates are made directly from digital data of a computer, because these radiation sources, which have a high output power despite their small size, can be easily obtained. However, since the sensitivities of many practically useful photosensitive recording materials are limited to light in a visible light region of 760 nm or less, the above-mentioned infrared lasers cannot be used for image recording. Accordingly, there is a demand for an image recording material which can be recorded on by an infrared laser.

Meanwhile, an example of a negative-type image recording material, which can be inscribed for recording by such an infrared laser, is described in Japanese Patent Application Laid-Open (JP-A) No. 8-276,558. This recording material comprises a substance which generates heat by absorbing light, an alkali-soluble resin, and a specific phenol derivative which has 4~8 benzene nuclei in the molecule. The drawback of this recording material was that the sensitivity of the material to a laser was insufficient. Despite many proposals to increase the sensitivity of the recording material, the material has been associated with the problem that in general measures to increase sensitivity tend to impair the storage stability of the recording material, and in particular, the storage stability in highly humid conditions.

Accordingly, there has been a strong demand for a hardenable material as an image recording material which has superior storage stability especially in such applications as materials for a heat-sensitive planographic printing plate and the like.

SUMMARY OF THE INVENTION

It is accordingly an object of the present invention to provide a heat-hardenable composition which has excellent storage stability, particularly in conditions of high temperature and high humidity, and which is suited for use as a material for a heat-sensitive planographic form plate. Another object of the present invention is to provide a heat-sensitive recording material and a planographic form plate, which each have excellent storage stability, by using the heat-hardenable composition of the present invention.

After intense studies, the present inventors found that, when heated, a specific thermally reactive compound forms a reactive group, which reacts with a group capable of reacting therewith and present in the vicinity thereof, thus causing a cross-linking reaction which leads to a hardening phenomenon. Further, they found that the specific thermally reactive compound has excellent storage stability, too. Based on these findings, they have achieved the present invention.

Namely, the present invention provides a heat-hardenable composition which comprises a compound having two or more sulfonic acid ester groups each capable of releasing sulfonic acid by the action of heat. Preferably, the heat-hardenable composition of the present invention further comprises a compound having two or more groups each reactive with the group generated by thermal release of sulfonic acid. Preferably, the compound having two or more sulfonic acid ester groups each capable of releasing sulfonic acid by the action of heat contains the structure represented by the following general formula (1):

General formula (1)

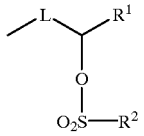

where L represents an organic group comprising polyvalent non-metallic atoms which is necessary for linking the structure represented by the general formula (1) to a polymer skeleton; and $R^1$ and $R^2$ each represent a substituted or unsubstituted alkyl group or a substituted or unsubstituted aryl group.

Preferably, the group reactive with the group generated by thermal release of sulfonic acid is a functional group selected from the group consisting of a hydroxyl group, a carboxyl group, an amino group, an amido group, and a sulfonamide group.

And, preferably, the compound having two or more sulfonic acid ester groups, each capable of releasing sulfonic acid by the action of heat, has an alkali-soluble group in addition thereto.

Further, the present invention provides a heat-hardenable composition comprising a compound which has two or more sulfonic acid ester groups each capable of releasing sulfonic acid by the action of heat and which has two or more groups each reactive with the group generated by thermal release of sulfonic acid. Preferably, the compound, which has two or more sulfonic acid ester groups each capable of releasing sulfonic acid by the action of heat and which has two or more groups each reactive with the group generated by thermal release of the sulfonic acid, contains the structure represented by the general formula (1).

Preferably, the above-mentioned group, which is reactive with the group generated by thermal release of sulfonic acid, is a functional group selected from the group consisting of a hydroxyl group, a carboxyl group, an amino group, an amido group, and a sulfonamide group. And, preferably, the compound which, has two or more sulfonic acid ester groups each capable of releasing sulfonic acid by the action of heat and which has two or more groups each reactive with the group generated by thermal release of sulfonic acid, has an alkali-soluble group in addition thereto.

Preferably, the heat-hardenable composition of the present invention further contains a substance capable of converting infrared into heat.

Further, the present invention provides a planographic form plate comprising a substrate and an infrared light-sensitive layer provided thereon which layer is composed of the heat-hardenable composition of the present invention.

Still further, the present invention provides a sulfonic acid ester compound containing the structure represented by the general formula (2):

General formula (2)

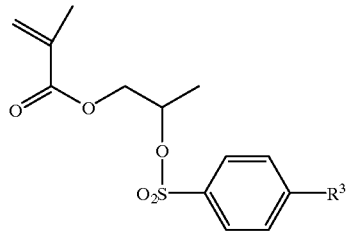

wherein $R^3$ represents a hydrogen atom, a chlorine atom, a methyl group, a methoxy group, or an acetoamide group.

The details of the hardening mechanism of the heat-hardenable composition of the present invention are not clear. However, some experimental results suggest that the following reactions will take place. That is, heating decomposes the sulfonic acid ester and generates a reactive site such as a carbocation. A nucleophilic reactant such as a cross-linking agent reacts with the reactive site to create a linkage. In this way, a hardening reaction will take place.

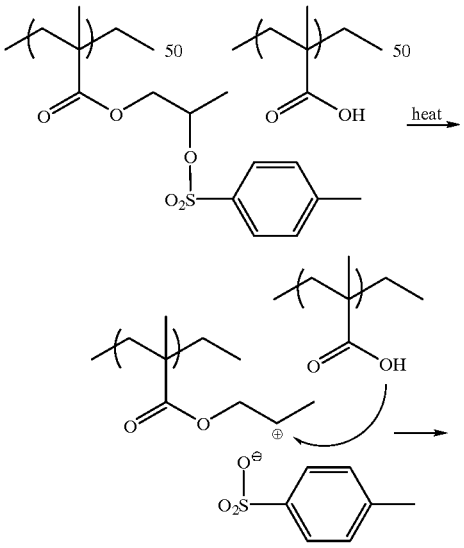

-continued

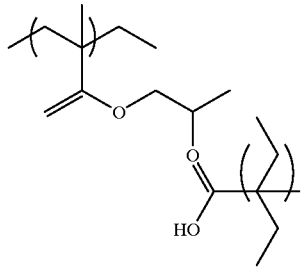

crosslinking

DETAILED DESCRIPTION OF THE PREFERRED EMBODIMENT

[Heat-hardenable Composition]

The details of the present invention will be explained below based on a preferred embodiment.

The heat-hardenable composition of the present embodiment contains a compound having at least two sulfonic acid ester groups each capable of releasing sulfonic acid by the action of heat (this compound is hereinafter referred to as "sulfonic acid ester compound" on occasion). Preferably, the heat-hardenable composition of the present embodiment further contains a compound having two or more groups each reactive with the group generated by thermal release of sulfonic acid (this compound is hereinafter referred to as "cross-linking aid agent" on occasion).

(Sulfonic Acid Ester Compound)

The sulfonic acid ester compound of the present embodiment is not particularly limited, providing the sulfonic acid ester compound has a sulfonic acid ester group capable of releasing sulfonic acid by the action of heat and thus generating a reactive site which can be attacked by a nucleophilic reactant species such as a cross-linking aid agent.

From the standpoint of reactivity, the above-mentioned sulfonic acid ester compound is preferably a sulfonic acid ester of a secondary alcohol, and more preferably a sulfonic acid ester containing the structure represented by the general formula (1).

In the general formula (1), L represents an organic group containing polyvalent non-metallic atoms which is necessary for linking the structure represented by the general formula (1) to the skeleton of the sulfonic acid ester compound.

The polyvalent linking group, which is represented by L and composed of nonmetallic atoms, comprises 1 to 60 carbon atoms, 0 to 10 nitrogen atoms, 0 to 50 oxygen atoms, 1 to 100 hydrogen atoms, and 0 to 20 sulfur atoms. A more specific example of the linking group has a structure composed of a combination of the following structural units:

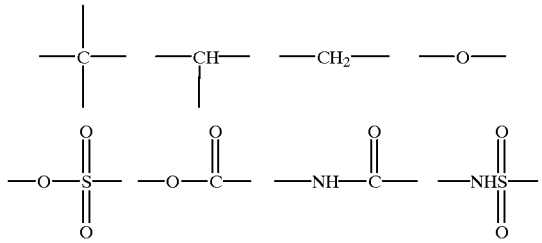

-continued

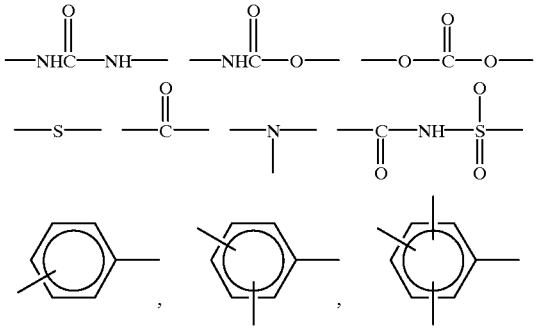

Polyvalent naphthalene, Polyvalent anthracene

If the polyvalent linking group bears a substituent, the substituent group may be selected from the alkyl group having 1 to 20 carbon atoms such as the methyl group and the ethyl group, the aryl group having 6 to 16 carbon atoms such as the phenyl group and the naphthyl group, the hydroxyl group, the carboxyl group, the sulfonamide group, the N-sulfonylamide group, the acyloxy group having 1 to 6 carbon atoms such as the acetoxy group, the alkoxy group having 1 to 6 carbon atoms such as the methoxy group and the ethoxy group, a halogen atom such as chlorine and bromine, the alkoxycarbonyl group having 2 to 7 carbon atoms such as methoxycarbonyl, ethoxycarbonyl, and cyclohexyloxycarbonyl, the cyano group, the carbonic acid ester group such as t-butyl carbonic acid ester, and the like.

Part of L and $R^1$ may join together to form a ring comprising nonmetallic atoms.

In the general formula (1), $R^1$ and $R^2$ each represent a substituted or unsubstituted alkyl group or a substituted or unsubstituted aryl group.

If $R^1$ and $R^2$ each represent an aryl or substituted aryl group, the aryl group includes a carbocyclic aryl group and a heterocyclic aryl group. Examples of the carbocyclic aryl group include carbocyclic aryl groups having 6 to 19 carbon atoms such as the phenyl group, the naphthyl group, the anthracenyl group, the pyrenyl group, and the like. Examples of the heterocyclic aryl group include heterocyclic groups having 3 to 20 carbon atoms and 1 to 5 heteroatoms such as pyridyl and furyl groups as well as heterocyclic groups having a benzene ring fused thereto such as quinolyl, benzofuryl, thioxanthone, carbazole, and the like. If $R^1$ and $R^2$ each represent an alkyl group or a substituted alkyl group, examples of the alkyl group include normal (straight-carbon-chain), branched, and cyclic alkyl groups having 1 to 25 carbon atoms such as the methyl group, the ethyl group, the isopropyl group, the t-butyl group, the cyclohexyl group, and the like.

If $R^1$ and $R^2$ each represent a substituted aryl, substituted heteroaryl, or substituted alkyl group, examples of the substituent include the alkoxy group having 1 to 10 carbon atoms such as the methoxy group, the ethoxy group, and the like; halogen atoms such as fluorine, chlorine, bromine atoms and the like; the halogenated alkyl group such as the trifluoromethyl group, the trichloromethyl group, and the like; the alkoxycarbonyl group or the aryloxycarbonyl group having 2 to 15 carbon atoms such as the methoxycarbonyl group, the ethoxycarbonyl group, the t-butyloxycarbonyl group, the p-chlorophenyloxycarbonyl group, and the like; the hydroxy group; the acyloxy group such as the acetyloxy group, the benzoyloxy group, the p-diphenylaminobenzoyloxy group, and the like; the carbonic acid ester group such as the t-butyloxycarbonyloxy group and the like; the ether group such as the t-butyloxycarbonylmethyloxy group, the 2-pyranyloxy group, and the like; the substituted or unsubstituted amino group such as the amino group, the dimethylamino group, the diphenylamino group, the morpholino group, the acetylamino group, and the like; the thioether group such as the methylthio group, the phenylthio group, and the like; the alkenyl group such as the vinyl group, the styryl group, and the like; the nitro group; the cyano group; the acyl group such as the formyl group, the acetyl group, the benzoyl group, and the like; the aryl group such as the phenyl group, the naphthyl group, and the like; the heteroaryl group such as the pyridyl group and the like; and others.

If $R^1$ and $R^2$ each represent the substituted aryl group or the substituted heteroaryl group, the substituent may be the alkyl group such as the methyl group, the ethyl group, and the like.

If $R^2$ is a substituted or unsubstituted aryl group, such an aryl group needs to be a group which exhibits no absorption in a visible light region so as to reduce the coloration of a hardenable layer. That is, the molar absorption coefficient of the structural unit represented by the general formula (1) is preferably 1,000 or less at 400 nm.

Particularly useful alkyl and aryl groups are a substituted or unsubstituted alkyl group having 1 to 10 carbon atoms for $R^3$, and a substituted or unsubstituted alkyl group having 1 to 10 carbon atoms and a substituted or unsubstituted phenyl group for $R^2$. If $R^1$ and $R^2$ are such alkyl or aryl groups, especially preferred substituents thereof are the alkoxy group having 1 to 5 carbon atoms, the alkoxycarbonyl group having 2 to 8 carbon atoms, the acyl group having 2 to 8 carbon atoms, the halide group, the cyano group, and the amido group. If $R^1$ and $R^2$ are alkyl groups, a preferred substituent thereof is a phenyl group, while, if $R^1$ and $R^2$ are aryl groups, a preferred substituent thereof is an alkyl group. Apart of $R^1$ may be bonded to L to form a ring comprising nonmetallic atoms.

Most preferably, $R^1$ is an alkyl group having 1 to 5 carbon atoms or an alkoxy group having 1 to 5 carbon atoms, and $R^2$ is a phenyl group or a substituted phenyl group, wherein the substituents are selected from a halogen atom, an alkyl group having 1 to 5 carbon atoms, an alkoxy group having 1 to 5 carbon atoms, and an acetoamide group.

The sulfonic acid ester compound may have a low molecular weight or a high molecular weight. Specific examples of the sulfonic acid ester compound having a low molecular weight include the following compounds.

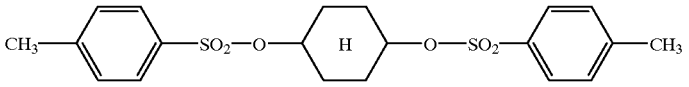

-continued

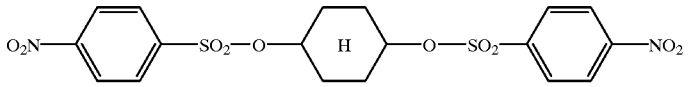

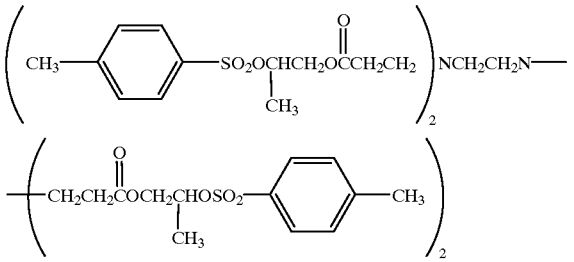

If a sulfonic acid ester compound having a high molecular weight is used, the weight average molecular weight thereof is preferably about 10,000 to 100,000. Such a sulfonic acid ester compound having a high molecular weight can be obtained by polymerizing a monomer having a sulfonic acid ester group. A preferred example of the monomer having a sulfonic acid ester group is the monomer represented by the general formula (2). Specific examples of the monomer include the following monomers [M-1] to [M-11].

M-1

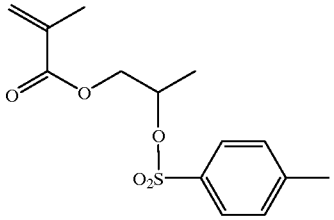

M-2

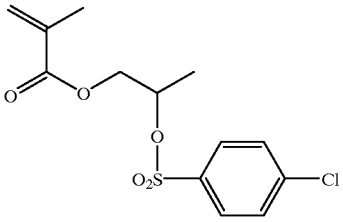

M-3

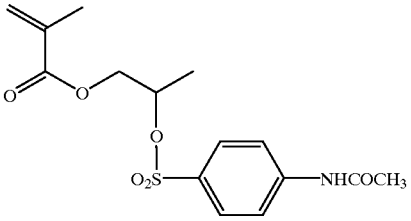

-continued

M-4

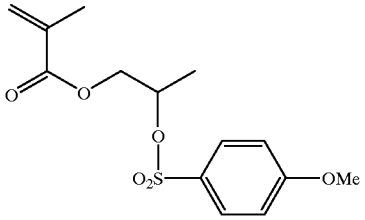

M-5

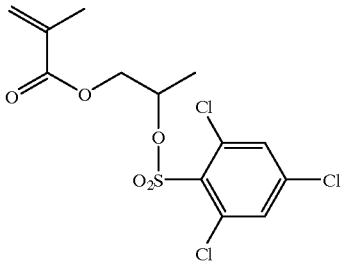

M-6

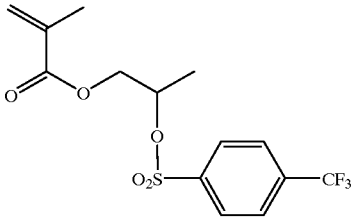

M-7

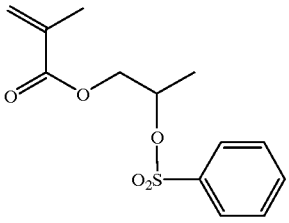

-continued
M-8
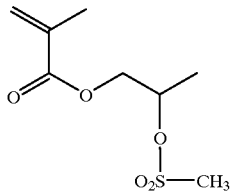
M-9
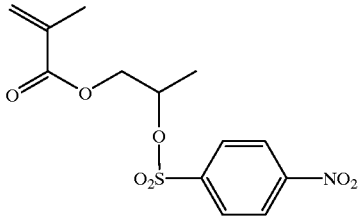
M-10
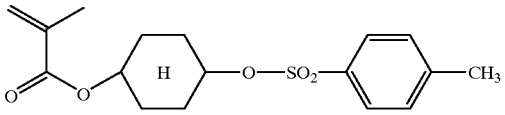
M-11
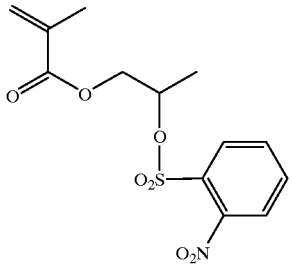
Specific examples of the sulfonic acid ester compound having a high molecular weight obtained by the homopolymerization of a monomer having a sulfonic acid ester group include the following compounds [P-1] to [P-9].
P-1
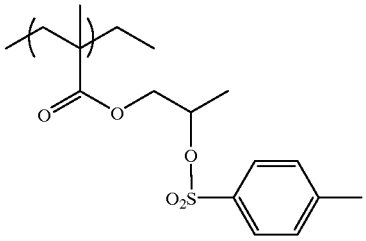
P-2
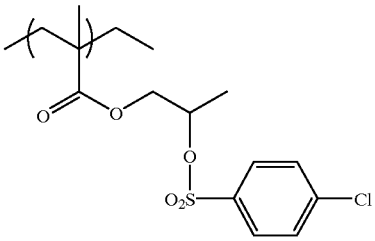
-continued
P-3
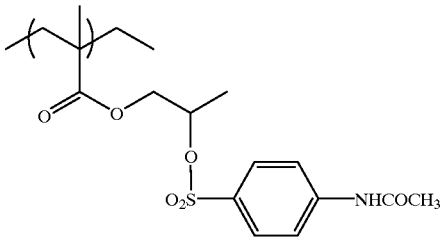
P-4
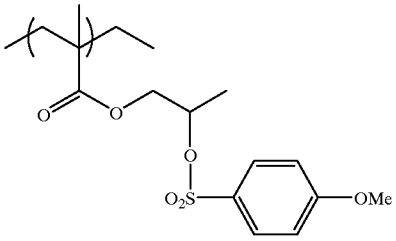
P-5
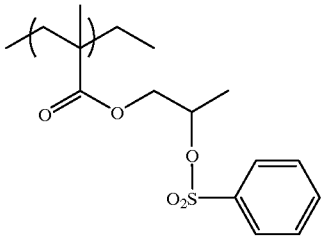
P-6
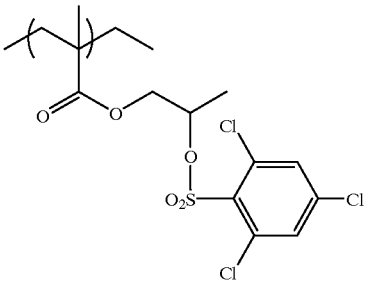
P-7
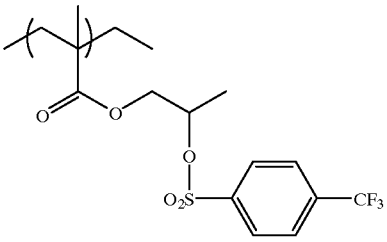
P-8
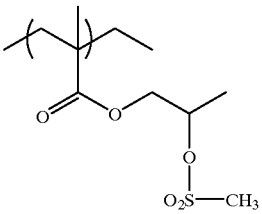

-continued

P-9

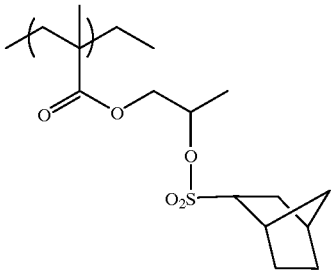

From the standpoint of developing-properties, it is preferable that the sulfonic acid ester compound has an alkali-soluble group in addition. Examples of the alkali-soluble group include the carboxyl group, the sulfonic acid group, the phenolic hydroxyl group, and the like.

(Cross-linking Aid Agent)

In the present embodiment, in order to cause a hardening reaction in an efficient way, a polyvalent nucleophilic reactant species, which has two or more nucleophilic functional groups and which acts as a cross-linking aid agent, is preferably incorporated in the composition.

The nucleophilic functional group is not particularly limited as long as it is a functional group capable of reacting with an active agent such as a carbocation and the like. Preferred examples of the nucleophilic functional group include weakly acidic functional groups, which have an acid dissociation constant pka of 2 or greater (this condition of acidity applies to the conjugate acid of the compound when the compound has no dissociative hydroxyl group, like an amine) and which are exemplified by the amino group, the mercapto group, the phenolic hydroxyl group, the amido group, and the sulfonamide groups in addition to the hydroxyl group, the carboxyl group, and the like. Among these functional groups, the hydroxyl group and the carboxyl group are particularly preferred from the standpoint of stability on standing and hardenability.

Examples of the polyhydric alcohol which can be used include polyhydric alcohols such as adonitol and sorbitol in addition to dihydric alcohols such as ethylene glycol and trimethylene glycol, and trihydric or tetrahydric alcohols such as trimethylol propane, pentaerythritol, and the like. Also usable are compounds having a high molecular weight such as poly(hydroxyethyl acrylate), poly(4-hydroxyphenylmethacrylamide), and the like in addition to compounds having a low molecular weight.

Examples of the polyhydric carboxylic acid which are useful include compounds having a high molecular weight such as polymethacrylic acid, and polyacrylic acid, and the like in addition to polyhydric carboxylic acids having a low molecular weight such as succinic acid, glutaric acid, citric acid, terephthalic acid, benzenetetracarboxylic acid, and the like.

The above-described nucleophilic reactant species may be used singly or in a combination of two or more.

The sulfonic acid ester compound may have in the molecule thereof a group (hereinafter referred to as "nucleophilic functional group") reactive with the group generated by thermal release of sulfonic acid, and examples of the nucleophilic functional groups include those exemplified by the nucleophilic functional groups of the aforementioned cross-linking aid agents. The sulfonic acid ester compound having in the molecule thereof a nucleophilic functional group can be synthesized by, for example, the copolymerization of a monomer having a nucleophilic functional group with a monomer having a sulfonic acid ester group.

Specific examples of sulfonic acid ester compounds [CP-1] to [CP-10] having in the molecule thereof a nucleophilic functional group are given below.

CP-1

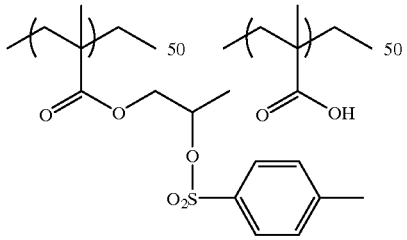

CP-2

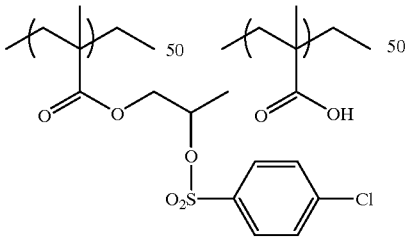

CP-3

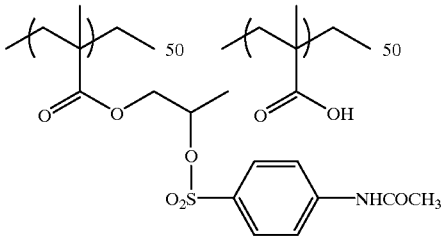

CP-4

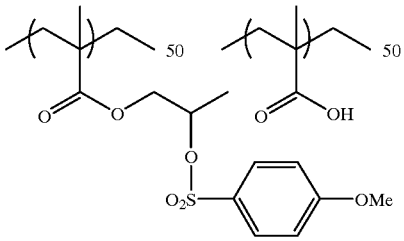

CP-5

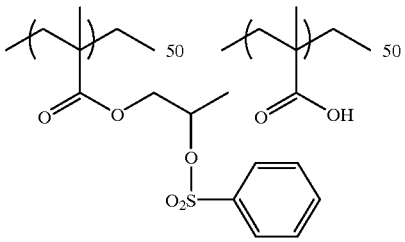

-continued

CP-6

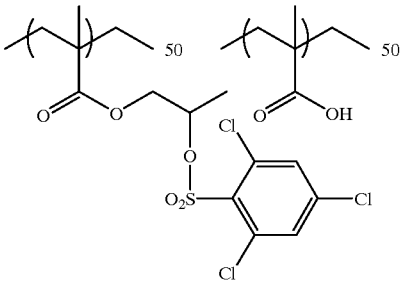

CP-7

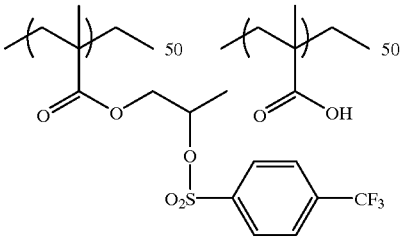

CP-8

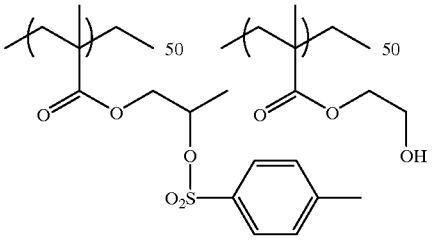

CP-9

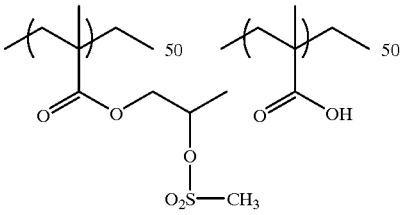

CP-10

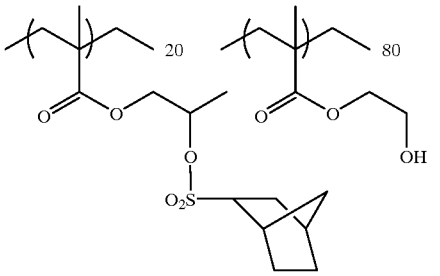

The sulfonic acid ester compound of the present embodiment may comprise other copolymerization components.

Preferred examples of the other monomer for copolymerization are cross-linkable monomers such as glycidyl methacrylate, N-methylolmethacrylamide, ω-(trimethoxysilyl)propyl methacrylate, 2-isocyanateethyl acrylate, and the like.

Examples of additional other monomers for use in the preparation of copolymers include known monomers such as acrylic acid esters, methacrylic acid esters, acrylamides, methacrylamides, vinyl esters, styrenes, acrylic acid, methacrylic acid, acrylonitrile, maleic anhydride, and maleic acid imides.

Specific examples of the acrylic ester include methyl acrylate, ethyl acrylate, (n- or i-) propyl acrylate, (n-, i-, sec- or t-)butyl acrylate, amyl acrylate, 2-ethylhexyl acrylate, dodecyl acrylate, chloroethyl acrylate, 2-hydroxyethyl acrylate, 2-hydroxypropyl acrylate, 5-hydroxypentyl acrylate, cyclohexyl acrylate, allyl acrylate, trimethylolpropane monoacrylate, pentaerythritol monoacrylate, benzyl acrylate, methoxybenzyl acrylate, chlorobenzyl acrylate, hydroxybenzyl acrylate, hydroxyphenethyl acrylate, dihydroxyphenethyl acrylate, furfuryl acrylate, tetrahydrofurfuryl acrylate, phenyl acrylate, hydroxyphenyl acrylate, chlorophenyl acrylate, sulfamoylphenyl acrylate, 2-(hydroxyphenylcarbonyloxy)ethyl acrylate, and the like.

Specific examples of the methacrylic acid ester include methyl methacrylate, ethyl methacrylate, (n- or i-) propyl methacrylate, (n-, i-, sec- or t-)butyl methacrylate, amyl methacrylate, 2-ethylhexyl methacrylate, dodecyl methacrylate, chloroethyl methacrylate, 2-hydroxyethyl methacrylate, 2-hydroxypropyl methacrylate, 5-hydroxypentyl methacrylate, cyclohexyl methacrylate, allyl methacrylate, trimethylolpropane monomethacrylate, pentaerythritol monomethacrylate, glycidyl methacrylate, benzyl methacrylate, methoxybenzyl methacrylate, chlorobenzyl methacrylate, hydroxybenzyl methacrylate, hydroxyphenethyl methacrylate, dihydroxyphenethyl methacrylate, furfuryl methacrylate, tetrahydrofurfuryl methacrylate, phenyl methacrylate, hydroxyphenyl methacrylate, chlorophenyl methacrylate, sulfamoylphenyl methacrylate, 2-(hydroxyphenylcarbonyloxy) ethyl methacrylate, and the like.

Specific examples of the acrylamide include acrylamide, N-methylacrylamide, N-ethylacrylamide, N-propylacrylamide, N-butylacrylamide, N-benzylacrylamide, N-hydroxyethylacrylamide, N-phenylacrylamide, N-tolylacrylamide, N-(hydroxyphenyl)acrylamide, N-(sulfamoylphenyl) acrylamide, N-(phenylsufonyl)acrylamide, N-(tolylsulfonyl)acrylamide, N,N-dimethylacrylamide, N-methyl-N-phenylacrylamide, N-hydroxyethyl-N-methylacrylamide, and the like.

Specific examples of the methacrylamide include methacrylamide, N-methylmethacrylamide, N-ethylmethacrylamide, N-propylmethacrylamide, N-butylmethacrylamide, N-benzylmethacrylamide, N-hydroxyethylmethacrylamide, N-phenylmethacrylamide, N-tolylmethacrylamide, N-(hydroxyphenyl) methacrylamide, N-(sulfamoylphenyl)methacrylamide, N-(phenylsufonyl)methacrylamide, N-(tolylsulfonyl) methacrylamide, N,N-dimethylmethacrylamide, N-methyl-N-phenylmethacrylamide, N-hydroxyethyl-N-methylmethacrylamide, and the like.

Specific examples of the vinyl ester include vinyl acetate, vinyl butyrate, vinyl benzoate, and the like.

Specific examples of the styrene include styrene, methylstyrene, dimethylstyrene, trimethylstyrene, ethylstyrene, propylstyrene, cyclohexylstyrene, choromethylstyrene, trifluoromethylstyrene, ethoxymethylstyrene, acetoxymethylstyrene, methoxystyrene, dimethoxystyrene, chlorostyrene, dichlorostyrene, bromostyrene, iodostyrene, fluorostyrene, carboxystyrene, and the like.

Among these other monomers, particularly preferable monomers are acrylic acid ester, methacrylic acid ester, acrylamides, methacrylamides, vinyl esters, styrenes, acrylic acid, methacrylic acid, and acrylonitrile, each having 20 or less carbon atoms.

The proportion of the monomer having a sulfonic acid ester group to be used for the synthesis of the copolymer is preferably 1 to 99 mol %, and more preferably 5 to 90 mol %. On the other hand, the proportion of the monomer having a nucleophilic functional group to be used for the synthesis of the copolymer is preferably 1 to 99 mol %, and more preferably 10 to 95 mol %.

If necessary, the heat-hardenable composition of the present embodiment may further contain additional components such as a substance capable of converting light to heat, an alkali-soluble resin, an acid generating agent, and the like. Further, a structure, which comprises a substrate having a photosensitive layer provided thereon, which layer comprises the heat-hardenable composition composed of the above-mentioned components, can be used as photosensitive, heat-sensitive recording materials including a heat-sensitive planographic form plate. The sulfonic acid ester group containing compound and the cross-linking aid agent may be contained in different layers, if these layers are arranged such that thermal contact of these layers is possible.

(Substance Capable of Converting Light to Heat)

Preferably, the heat-hardenable composition of the present embodiment contains a substance capable of converting light to heat. Any substance capable of absorbing light, e.g., ultraviolet light, visible light, infrared light, white light, or the like, and converting the light absorbed to heat can be used as such in the present embodiment. Examples of the substance include carbon black, carbon graphite, pigments, phthalocyanine-based pigments, iron powder, graphite powder, iron oxide powder, lead oxide, silver oxide, chromium oxide, iron sulfide, chromium sulfide, and the like. Particularly preferred are dyes, pigments, and metals which effectively absorb infrared light in the wavelength region of from 760 to 1200 nm. By adding the above-mentioned substance capable of converting infrared light to heat, the heat-hardenable composition, when irradiated with infrared light, can be made to harden at the irradiated portion.

The dyes suitable for use in the present embodiment are commercially available dyes and those described in, for example, "Senryo-Binran (Handbook of Dyes)", edited by The Society of Synthetic Organic Chemistry, Japan (1970). Specific examples of the dyes include azo dyes, azo dyes in the form of a metallic complex salt, pyrazolone azo dyes, anthraquinone dyes, phthalocyanine dyes, carbonium dyes, quinoneimine dyes, methine dyes, cyanine dyes, dyes in the form of metal thiolate complex, and the like.

Preferred examples of the dyes include cyanine dyes described in, e.g., JP-A Nos. 58-125,246, 59-84,356, 59-202,829, and 60-78,787, methine dyes described in, e.g., JP-A Nos. 58-173,696, 58-181,690, and 58-194,595, naphthoquinone dyes described in, e.g., JP-A Nos. 58-112,793, 58-224,793, 59-48,187, 59-73,996, 60-52,940, and 60-63,744, squalylium dyes described in JP-A No. 58-112,792, and cyanine dyes described in U. K. Patent No. 434,875.

Other suitable compounds are a near-infrared absorbing sensitizer described in U.S. Pat. No. 5,156,938, a substituted arylbenzo(thio)pyrylium salt described in U.S. Pat. No. 3,881,924, a trimethinethiapyrylium salt described in JP-A No. 57-142,645 (U.S. Pat. No. 4,327,169), pyrylium compounds described in JP-A Nos. 58-181,051, 58-220,143, 59-41,363; 59-84,248, 59-84,249, 59-146,063, and 59-146,061, a cyanine dye described in JP-A No. 59-216,146, a pentamethinethiopyrylium salt described in U.S. Pat. No. 4,283,475, and pyrylium compounds described in JP-B Nos. 5-13,514 and 5-19,702. Further examples of the preferred dyes are near-infrared absorbing dyes represented by the formulas (I) and (II) in U.S. Pat. No. 4,756,993.

Among these dyes, cyanine dyes, squalylium dyes, pyrylium dyes, and nickel thiolate complexes are particularly preferable.

The pigments suitable for use in the present invention include commercially available pigments and those described in, for example, "Color Index (C. I.) Handbook", "Latest Pigment Handbook" (Saishin Ganryo Binran) edited by Japan Pigment Technologies Association (Nihon Ganryo Gijutsu Kyokai) (1977), "Latest Pigment Application Technologies" (Saishin Ganryo Oyo Gijutsu), CMC, 1986 and "Printing Ink Technologies" (Insatsu Inki Gijutsu), CMC, 1984.

Examples of the pigments include black pigments, yellow pigments, orange pigments, brown pigments, red pigments, purple pigments, blue pigments, green pigments, fluorescent pigments, metal powder pigments, and dyes chemically combined with polymers. Specific examples of the pigments are insoluble azo pigments, azo lake pigments, condensed azo pigments, chelated azo pigments, phthalocyanine based pigments, anthraquinone based pigments, perylene and perinone based pigments, thioindigo based pigments, quinacridone based pigments, dioxazine based pigments, isoindolinone based pigments, quinophthalone based pigments, dyed lake pigments, azine pigments, nitroso pigments, nitro pigments, natural pigments, fluorescent pigments, inorganic pigments, carbon black, and the like. Among these pigments, carbon black is preferable.

These pigments may be used without being surface-treated or may be used after being surface-treated. Possible surface treatments include a treatment wherein a resin or a wax is coated on the surface of the pigments, a treatment wherein a surfactant is adhered to the surface of the pigments, and a treatment wherein a reactive substance (e.g., a silane coupling agent, an epoxy compound, or a polyisocyanate) is bound to the surface of the pigments. These surface-treating methods are described in "Properties and Applications of Metal Soaps" (Saiwai Shobo Co., Ltd.), "Printing Ink Technologies" (Insatsu Inki Gijutsu), CMC, 1984 and "Latest Pigment Application Technologies" (Saishin Ganryo Oyo Gijutsu), CMC, 1986.

The diameter of the pigments is preferably in the range of from 0.01 to 10 $\mu$m, more preferably in the range of from 0.05 to 1 $\mu$m, and most preferably in the range of from 0.1 to 1 $\mu$m. If the diameter is less than 0.01 $\mu$m, the dispersion stability of the pigments in a coating liquid to form a heat-sensitive recording layer is insufficient, whereas, if the diameter is greater than 10 $\mu$m, the uniformity of the heat-sensitive recording layer after coating is poor.

A known dispersing technology using a dispersing machine employed in the preparation of ink and toners can also be used for the purpose of dispersing the pigments. Examples of the dispersing machine include an ultrasonic wave dispersing machine, a sand mill, an attritor, a pearl mill, a super mill, a ball mill, an impeller, a disperser, a KD mill, a colloid mill, a dynatron, a three-roller mill, a pressurized kneader, and the like. Details of these dispersing technologies are described in "Latest Pigment Application Technologies" (Saishin Ganryo Oyo Gijutsu), CMC, 1986.

The amounts of the dye or the pigment to be added in the heat-hardenable composition are in the range of from 0.01 to 50% by weight, and more preferably in the range of from 0.1 to 10% by weight, based on the weight of the total solid components of the composition. When a dye is used, the amount of the dye to be added is most preferably in the range of from 0.5 to 10% by weight. When a pigment is used, the amount of the pigment to be added is in the range of from 3.1 to 10% by weight. If the amount added of the pigment or the dye is less than 0.01% by weight, the sensitivity of the composition may decrease, whereas, if the amount added is more than 50% by weight, non-image areas tend to be smudgy.

(Alkali-soluble Resin)

The binder polymer for use in the present embodiment is a polymer whose side chain or main chain has an aromatic hydrocarbon ring to which a hydroxyl or alkoxy group is directly linked. From the standpoint of sensitivity, the number of carbon atoms in the alkoxy group is preferably 20 or less. As for the aromatic hydrocarbon ring, abenzene ring, a naphthalene ring, or an anthracene ring is preferred because of the availability of raw materials. Although these aromatic hydrocarbon rings may bear a substituent such as a halide group, a cyano group, and the like other than hydroxyl and alkoxy groups, it is preferable that these aromatic hydrocarbon rings bear no substituent other than hydroxyl and alkoxy groups in terms of sensitivity.

The binder polymer suited for use in the present embodiment is either a polymer having the structural unit represented by the following general formula (3) or a phenolic resin such as a novolac resin or the like.

General formula (3)

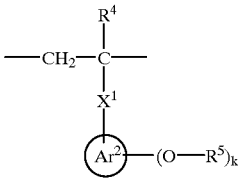

In the above formula, $Ar^2$ represents a benzene ring, a naphthalene ring, or an anthracene ring. $R^4$ represents a hydrogen atom or a methyl group. $R^5$ represents a hydrogen atom or an alkoxy group having 20 or less carbon atoms. $X^1$ represents either a single bond or a divalent linking group which contains one or more atoms selected from C, H, N, O, and S and which has 0 to 20 carbon atoms. k is an integer of 1 to 4.

Next, novolac resins are described below. Novolac resins suited for use in the present embodiment include aphenol novolac, o-, m- , and p-cresol novolacs and copolymers thereof, and a novolac made from a phenol substituted by a halogen atom, an alkyl group, or the like.

The weight average molecular weight of these novolac resins is preferably 1,000 or greater, and more preferably in the range of from 2,000 to 20,000; while the number weight average molecular weight is preferably 1,000 or greater, and more preferably in the range of from 2,000 to 15,000. The index of polydispersity is preferably 1 or greater, and more preferably in the range of from 1.1 to 10.

The binder polymers described above for use in the present embodiment may be used singly or in a combination of two or more. The content of the polymer in the heat-hardenable composition is in the range of 20 to 95% by weight, and preferably in the range of from40 to 90% by weight, with respect to the total solids of the heat-hardenable composition. If the content is less than 20% by weight, the strength of image areas formed may be insufficient, whereas, if the content is more than 95% by weight, image formation is impossible.

(Acid Generating Agents)

Examples of the acid generating agent include onium salts such as diazonium salts described in, e.g., S. I. Schlesinger, Photogr. Sci. Bng., 18, 387(1974) and T. S. Baletatal, Polymer, 21, 423(1980), ammonium salts described in, e.g., U.S. Pat. Nos. 4,069,055, 4,069,056, and JP-A No. 3-140, 140, phosphonium salts described in, e.g., D. C. Necker et al, Macromolecules, 17, 2468(1984), C. S. Wen et al, Teh. Proc. Conf. Rad. Curing ASIA, p.478, Tokyo, October (1988), U.S. Pat. Nos. 4,069,055 and4,069,056, iodonium salts described in, e.g., J. V. Crivello et al, Macromolecules, 10(6), 1307(1977), Chem. & Eng. News, No.28, p.31(1988), European Patent No. 104,143, U.S. Pat. Nos. 3,339,049, 4,410,201, JP-A No. 2-150,848 and 2-296,514, sulphonium salts described in, e.g., J. V. Crivello et al, Polymer J. 17, 73(1985), J. V. Crivello et al, J. Org. Chem., 43, 3055(1978), W. R. Watt et al, J. Polymer Sci., Polymer Chem. Ed., 22, 1789(1984), J. V. Crivello et al, Polymer Bull., 14, 279 (1985), J. V. Crivello et al, Macromolecules, 14(5), 1141 (1981), J. V. Crivello et al, J. Polymer Sci., Polymer Chem. Ed., 17, 2877(1979), European Patent No. 370,693, U.S. Pat. No. 3,902,114, European Patent Nos. 233,567, 297,443, 297,442, U.S. Pat. Nos. 4,933,377, 4,410,201, 3,339,049, 4,760,013, 4,734,444, 2,833,827, German Patent Nos. 2,904,626,3,604,580, and 3,604,581, selenonium salts described in, e.g., J. V. Crivello et al, Macromolecules, 10(6), 1307(1977) and J. V. Crivello et al, J. Polymer Sci., Polymer Chem. Ed., 17, 1047(1979), and arsonium salts described in, e.g., C. S. Wen et al, Teh, Proc. Conf. Rad. Curing ASIA, p.478, Tokyo, Oct. (1988); organic halogen compounds described in, e.g., U.S. Pat. No. 3,905,815, JP-B No. 46-4,605, JP-A Nos. 48-36,281, 55-32,070, 60-239,736, 61-169,835, 61-169,837, 62-58,241, 62-212,401, 63-70,243, and63-298,339; organometallic/organic halogen compounds, described in, e.g., K. Meier et al, J. Rad. Curing, 13(4), 26(1986), T. P. Gill et al, Inorg. Chem., 19, 3007 (1980), D. Astruc, Acc. Chem. Res., 19(12), 377(1896), and JP-A No. 2-161,445; Photochemically acid-generating agents having o-nitrobenzyl type protective groups described in, e.g., S. Hayase et al, J. Polymer Sci., 25, 753(1987), E. Reichmanis et al, J. Polymer Sci., Polymer Chem. Ed., 23, 1(1985), Q. Q. Zhu et al, J. Photochem., 36, 85, 39, 317(1987), B. Amit et al, Tetrahedron Lett., (24) 2205, (1973), D. H. R. Barton et al, J. Chem. Soc., 3571 (1965), P. M. Collins et al, et al, J. Chem. Soc., Perkin I, 1695(1975), M. Rudinstein et al, Tetrahedron Lett., (17) 1445 (1975), J. W. Walker al, J. Am. Chem. Soc., 110, 7170(1988), S. C. Busman et al, J. Imaging Technol., 11(4), 191(1985), H. M. Houlihan et al, Macromolecules, 21, 2001(1988), P. M. Collins et al, et al, J. Chem. Soc., Chem. Commun., 532(1972), S. Hayase et al, Macromolecules, 18, 1799(1985), E. Reichmanis et al, J. Electrochem., Soc., Solid State Sci. Technol., 130(6), F. M. Houlihan et al, Macromolecules, 21, 2001(1988), European Patent Nos. 0, 290,750, 0,046,083, 0,156,535, 0,271,851, 0,388,343, U.S. Pat. Nos. 3,901,710, 4,181,531, JP-A Nos. 60-198,538, and 53-133,022; compounds such as iminosulfonic acid esters which undergo photolysis to generate sulfonic acid and are described in, e.g., M. Tunooka et al, Polymer Preprints Japan, 35(8), G. Berner et al, Rad. Curing, 13(4), W. J. Mijs et al, Coating Technol., 55(697), 45(1983), AKZO, H. Adachi et al, Polymer Preprints Japan, 37(3), European Patent Nos. 0,199,672, 0,084,515, 0,044,115, 0,101,122, U.S. Pat. Nos. 4,618,564, 4,371,605, 4,431,774, JP-A Nos. 64-18,143, 2-245,756, and Japanese Patent Application No. 3-140,019; disulfone compounds described in, e.g., JP-A No. 61-166,544; o-naphthoquinone diazide-4-sufonic acid halides described in, e.g., JP-A No. 50-36,209(U.S. Pat. No. 3,969,118); and o-naphthoquinone diazide compounds described in JP-A No. 55-62,444(U.K. Patent No. 2,038, 801) and JP-B No. 1-11,935.

Other acid generating agents include cyclohexyl citrate, sulfonic acid alkyl ester such as cyclohexyl p-acetoaminobenzenesulfonate and cyclohexyl p-bromobenzenesulfonate, and the alkyl sulfonic acid ester which is described in Japanese Patent Application No. 9-26,878 by the present inventors and represented by the following structural formula.

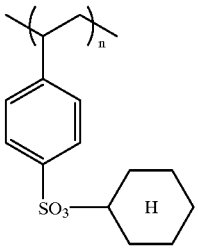

(Other Additives)

In the present embodiment, if necessary, components other than those described above may be added to the heat-hardenable composition. For example, a dye, which has a major absorption range in a visible light region, may be used as an image coloring agent.

Specific examples include Oil Yellow No. 101, Oil Yellow No. 103, Oil Pink No. 312, Oil Green BG, Oil Blue BOS, Oil Blue No. 603, Oil Black BY, Oil Black BS, and Oil Black T-505 (all manufactured by Orient Chemical Industries, Co., Ltd.), Victoria Pure Blue, Crystal Violet(C. I. 42555), Methyl Violet(C. I. 42535), Ethyl Violet, Rhodamine B(C. I. 145170B), Malachite Green(C. I. 42000), Methylene Blue (C. I. 52015), and dyes described in JP-A No. 62-293,247.

It is desirable to add this type of dye to the heat-hardenable composition, because this type of dye fades after being exposed to a laser and will make image areas more distinguishable from non-image areas. The amount of the dye to be added is in the range of from 0.01 to 10% by weight based on the weight of the total solids of the heat-hardenable composition.

Further, in order to increase stability of the heat-hardenable composition in the printing conditions, the heat-hardenable composition may contain a nonionic surfactant as described in JP-A Nos. 62-251,740 and 3-208,514, and an amphoteric surfactant as described in JP-A Nos. 59-121,044 and 4-13,149.

Specific examples of the nonionic surfactant include sorbitan tristearate, sorbitan monopalmitate, sorbitan trioleate, stearic acid monoglyceride, and polyoxyethylene nonylphenyl ether.

Specific examples of the amphoteric surfactant include alkyldi(aminoethyl)glycine, hydrochloric acid salt of alkylpolyaminoethylglycine, 2-alkyl-N-carboxyethyl-N-hydroxyethylimidazolinium betaine, and N-tetradecyl-N, N-betaine (e.g., "Amogen K" manufactured by Dai-ichi Kogyo Seiyaku Co., Ltd.).

The preferred contents of the nonionic surfactant and the amphoteric surfactant are in the range of from 0.05 to 15% by weight, and more preferably from 0.1 to 5% by weight, based on the weight of the heat-hardenable composition.

In order to impart flexibility to the coating layer, if necessary, a plasticizer may be incorporated into the composition for the recording layer in the present embodiment. Examples of the plasticizer include polyethylene glycol, tributyl citrate, diethyl phthalate, dibutyl phthalate, dihexyl phthalate, dioctyl phthalate, tricresyl phosphate, tributyl phosphate, trioctyl phosphate, tetrahydrofurfuryl oleate, and an oligomer or polymer of acrylic acid or methacrylic acid.

In addition to the above-mentioned plasticizers, other compounds usable as a plasticizer in the present embodiment are an epoxy compound, a vinyl ether compound, a phenolic compound having the hydroxymethyl group, a phenolic compound having the alkoxymethyl group. Further, another polymeric compound may be added in order to increase the strength of the coating layer.

[Planographic Form Plate]

Normally, the planographic form plate of the present embodiment can be prepared by applying a coating liquid, which is prepared by dissolving the above-described components in a solvent, on an appropriate substrate. Some illustrative nonlimiting examples of the solvent include ethylene dichloride, cyclohexanone, methyl ethyl ketone, methanol, ethanol, propanol, ethylene glycol monomethyl ether, 1-methoxy-2-propanol, 2-methoxyethyl acetate, 1-methoxy-2-propyl acetate, dimethoxyethane, methyl lactate, ethyl lactate, N,N-dimethylacetoamide, N,N-dimethylformamide, tetramethylurea, N-methylpyrrolidone, dimethyl sulfoxide, sulfolane, γ-butyrolactone, toluene, and water.

These solvents may be used singly or in a combination of two or more. The concentration of the aforementioned components (total solids including additives) in the solvent is preferably in the range of from 1 to 50% by weight. The coated amount (solids) after drying on the substrate varies according to applications, but the desirable amount is generally in the range of from 0.5 g to 5.0 g/m$^2$ in the preparation of a planographic form plate. The coating liquid can be applied by various methods. Examples of the methods include bar coating, rotational coating, spraying, curtain coating, dipping, air-knife coating, blade coating, and roll coating.

In order to achieve better coating of a recording layer, the heat-hardenable composition of the present embodiment may contain a surfactant. An example of such a surfactant is a fluorine-containing surfactant described in JP-A No. 62-170,950. The preferred amount to be added of the surfactant is in the range of from 0.01 to 1% by weight, more preferably in the range of from 0.05 to 0.5% by weight, based on the weight of the total solids of the heat-hardenable composition.

A substrate for use in the present embodiment is preferably a dimensionally stable plate. Specific examples of the substrate include paper, paper laminated with a plastic (e.g., polyethylene, polypropylene, and polystyrene), metal plates (such as aluminum, zinc, and copper), plastic films (such as cellulose diacetate, cellulose triacetate, cellulose propionate, cellulose butyrate, cellulose butyrate acetate, cellulose nitrate, polyethylene terephthalate, polyethylene, polystyrene, polypropylene, polycarbonic acid ester, and polyvinyl acetal), paper or plastic films laminated or vapor-deposited with the aforementioned metals, and the like.

Among these materials, a polyester film and an aluminum plate are preferable for use as a substrate in the present embodiment. An aluminum plate is particularly preferable, because it has a good dimension stability and is relatively cheap. Examples of aluminum plate suited for use include a pure aluminum plate and a plate of an aluminum alloy which is made up of aluminum as a main component and a trace of other elements. A further example of the substrate is a plastic film which is laminated with aluminum or vapor-deposited with aluminum. Examples of the other elements which may be contained in the aluminum alloy include silicon, iron, manganese, copper, magnesium, chromium, zinc, bismuth, nickel, and titanium. The total content of the other element s to be contained in the aluminum alloy is 10% by weight or less. Although the aluminum particularly desirable for use in the present embodiment is pure aluminum, the aluminum of the present embodiment may contain a small amount of other elements, because limitations in purification technologies make the production of perfectly pure aluminum difficult. Accordingly, the composition of the aluminum plate for use in the present embodiment is not particularly limited, and a conventionally known aluminum plate may be used in the present embodiment. The thickness of the aluminum plate for use in the present embodiment is about 0.1 to 0.6 mm, preferably 0.15 to 0.4 mm, and most preferably 0.2 to 0.3 mm.

Before roughening the surface of the aluminum plate, a cleaning treatment may optionally be performed in order to remove any rolling oil from the surface of the aluminum plate by using a surfactant, an organic solvent, an aqueous solution of alkali, or the like.

The surface of the aluminum plate may be roughened by a variety of methods. Examples of these methods include a method wherein the surface is mechanically roughened, a method wherein the surface is roughened by being electrochemically dissolved, and a method wherein the surface is selectively dissolved in a chemical way. Examples of the mechanical methods are conventionally known methods including ball-abrasion, brush-abrasion, blasting, and buffing. An exemplary electrochemical method is immersion of the aluminum plate in an electrolyte solution, such as a hydrochloric acid or a nitric acid, while passing an a.c. current or a d.c. current. A combination of a mechanical method and an electrochemical method is also possible as described in JP-A No. 54-63,902.

EXAMPLES (Synthesis of a Sulfonic Acid Ester Compound [M-1])

72.1 g of 2-hydroxypropyl methacrylate, 95 g of p-toluenesulfonyl chloride, and 100 ml of acetonitrile were placed in a 500 ml three-neck flask. Then, 117 g of pyridine was added dropwise to the solution while it was stirred and cooled by ice. After the completion of the addition, the reaction solution was stirred for 5 hours at room temperature. The reaction solution thus obtained was then poured into an acidic aqueous solution prepared by diluting 100 ml of concentrated hydrochloric acid with 700 ml of icy water. After being left to stand for about 1 hour, the crystals deposited were collected by filtration. The crystals collected were purified by recrystallization using methanol, and 83.1 g of crystals was obtained. The melting point of the crystals was 67° C., and the NMR spectrum data (measured in $CDCl_3$) of the crystals were 1.31 (d, 3H), 1.88 (s, 3H), 2.42 (s, 3H), 4.1 (m, 2H) , 4.83 (m, 1H), 5.53 (s, 1H), 6.0 (s, 1H), 7.31 (d, 2H), and 7.80 (d, 3H).

(Synthesis of a Sulfonic Acid Ester Compound [M-2])

72.1 g of 2-hydroxypropyl methacrylate, 105 g of p-chlorobenzenesulfonyl chloride, and 50 ml of acetonitrile were placed in a 500 ml three-neck flask. Then, 117 g of pyridine was added dropwise to the solution while it was stirred and cooled by ice. After the completion of the addition, the reaction solution was stirred for 5 hours at room temperature. The reaction solution thus obtained was then poured into an acidic aqueous solution prepared by diluting 100 ml of concentrated hydrochloric acid with 700 ml of icy water. The mixture was extracted with 700 ml of ethyl acetate. The solution in ethyl acetate was dried using magnesium sulfate and the ethyl acetate was removed from the solution by distillation. The concentrated residue was purified by column chromatography (eluent employed was a 3:1 (v/v) mixture of hexane and ethyl acetate). In this way, 103.5 g of crystals was obtained. The melting point of the crystals was 47° C., and the NMR spectrum data (measured in $CDCl_3$) of the crystals were 1.35 (d, 3H), 1.88 (6s, 3H), 4.12 (m, 2H), 4.89 (m, 1H), 5.56 (6s, 1H), 5.98 (6s, 1H), 7.50 (d, 2H), and 7.83 (d, 2H).

(Synthesis of a Sulfonic Acid Ester Compound [M-3])

75.0 g of 2-hydroxypropyl methacrylate, 117 g of p-acetoamidobenzenesulfonyl chloride, and 100 ml of acetonitrile were placed in a 500 ml three-neck flask. Then, 117 g of pyridine was added dropwise to the solution while it was stirred and cooled by ice. After the completion of the addition, the reaction solution was stirred for 5 hours at room temperature. The reaction solution thus obtained was then poured into an acidic aqueous solution prepared by diluting 100 ml of concentrated hydrochloric acid with 700 ml of icy water. The mixture was extracted with 700 ml of ethyl acetate. The solution in ethyl acetate was dried using magnesium sulfate and the ethyl acetate was removed from the solution by distillation. The concentrated solution was left to stand, and the crystals deposited were collected by filtration. The crystals collected were purified by recrystallization from methanol, and 95.1 g of crystals was obtained. The melting point of the crystals was 108° C., and the NMR spectrum data (measured in $CDCl_3$) of the crystals were 1.22 (d, 3H), 1.79 (6s, 3H), 2.12 (s, 3H), 4.05 (m, 2H), 4.85 (m, 1H), 5.46 (6s, 1H), 5.93 (6s, 1H), 7.60 (d, 2H), and 7.73 (d, 2H).

(Synthesis of a Sulfonic Acid Ester Compound [M-4])

75.0 g of 2-hydroxypropyl methacrylate, 103 g of p-methoxybenzenesulfonyl chloride, and 100 ml of acetonitrile were placed in a 500 ml three-neck flask. Then, 117 g of pyridine was added dropwise to the solution while it was stirred and cooled by ice. After the completion of the addition, the reaction solution was stirred for 5 hours at room temperature. The reaction solution thus obtained was then poured into an acidic aqueous solution prepared by diluting 100 ml of concentrated hydrochloric acid with 700 ml of icy water. The mixture was extracted with 700 ml of ethyl acetate. The solution in ethyl acetate was dried using magnesium sulfate and the ethyl acetate was removed from the solution by distillation. The concentrated residue was purified by column chromatography (eluent employed was a 4:1 (v/v) mixture of hexane and ethyl acetate). In this way, 98.0 g of oil was obtained. The NMR spectrum data (measured in $CDCl_3$) of the oil were 1.33 (d, 3H), 1.90 (s, 3H), 2.04 (s, 3H), 4.3 (m, 2H), 4.84 (m, 1H), 5.55 (s, 1H), 6.3 (s, 1H), 7.20 (d, 2H), and 7.60 (d, 2H).

(Synthesis of a Sulfonic Acid Ester Compound [P-1] having a High Molecular Weight)

10.0 g of the sulfonic acid ester compound [M-1] synthesized above and 20 g of methyl ethyl ketone were placed in a three-neck flask, and the temperature of the solution was raised to 65° C. under a nitrogen stream. Then, 0.108 g of 2,2'-azobis(2,4-dimethylvaleronitrile) was added to the solution, and the solution was stirred for 2 hours while being kept at 65° C. Further, 0.054 g of 2,2'-azobis(2,4-dimethylvaleronitrile) was added to the solution, and the solution was stirred for2 hours while being kept at 65° C. Still further, 0.027 g of 2,2'-azobis(2,4-dimethylvaleronitrile) was added to the solution, and the solution was stirred for 2 hours while being kept at 65° C. After this, the solvent was removed by distillation at a reduced pressure. The residue was further dried at a reduced pressure to obtain a polymer as a reaction product. As a result of GPC measurement, this polymer was found to have a weight average molecular weight of 23,000.

(Synthesis of a Sulfonic Acid Ester Compound [CP-1] having a High Molecular Weight)

12.0 g of the sulfonic acid ester compound [M-1] synthesized above, 3.54 g of methacrylic acid, and 88 g of 1-methoxy-2-propanol were placed in a three-neck flask, and the temperature of the solution was raised to 65° C. under a nitrogen stream. Then, 0.13 g of 2,2'-azobis(2,4-dimethylvaleronitrile) was added to the solution, and the solution was stirred for 2 hours while being kept at 65° C. Further, 0.13 g of 2,2'-azobis (2,4-dimethylvaleronitrile) was added to the solution, and the solution was stirred for 4 hours while being kept at 65° C. After this, the solution was added to 500 ml of hexane to precipitate a polymer. The precipitated polymer was collected by filtration and dried at a reduced pressure. As a result of GPC measurement, this polymer was found to have a weight average molecular weight of 25,000.

(Synthesis of Sulfonic Acid Ester Compounds [CP-2] to [CP-4] having a High Molecular Weight)

Sulfonic acid ester compounds [CP-2] to [CP-4] having a high molecular weight were synthesized by repeating the procedure for synthesizing the sulfonic acid ester compound [CP-1] having a high molecular weight, except that the sulfonic acid ester compound [M-1] was replaced with sulfonic acid ester compounds [M-2] to [M-4], respectively. As a result of GPC measurement, the weight average molecular weights of these polymers were 34,000, 43,000, and 27,000, respectively.

(Synthesis of a Sulfonic Acid Ester Compound [CP-8] having a High Molecular Weight)

8.0 g of the sulfonic acid ester compound [M-1] synthesized above, 13.9 g of 2-hydroxyethyl methacrylate, and 43.8 g of methyl ethyl ketone were placed in a three-neck flask, and the temperature of the solution was raised to 65° C. under a nitrogen stream. Then, 0.432 g of 2,2'-azobis(2,4-dimethylvaleronitrile) was added to the solution, and the solution was stirred for 2 hours while being kept at 65° C.

Further, 0.216 g of 2,2'-azobis(2,4-dimethylvaleronitrile) was added to the solution, and the solution was stirred for 4 hours while being kept at 65° C. After this reaction time, the solution was added to 500 ml of hexane to precipitate a polymer. The precipitated polymer was collected by filtration and dried at a reduced pressure. As a result of GPC measurement, this polymer was found to have a weight average molecular weight of 22,000.

Examples 1 to 9

Solutions, each comprising 2.0 g of one of the sulfonic acid ester compounds listed in Table 1, 2.0 g of 1-methoxy-2-propanol, and 2.0 g of methyl ethyl ketone, were prepared. Each of the solutions was placed in an aluminum cylindrical container having a diameter of 5.5 cm and a depth of 7 mm such that a 2 mm thick liquid layer was obtained, and the solution was heated for 1 minute at 170° C. Next, the time required to heat the layer to the point where the layer could not be penetrated by a needle tip was measured by dropping a metal needle, which had a weight of 30 g and a tip diameter of 0.5 mm, freely from a height of 1 cm perpendicularly into the layer. This heating time was used to indicate the hardenability of the layer, i.e., the shorter the heating time, the better the hardenability. In addition, surface hardenability was examined visually and by touch. For the evaluation of the surface hardenability, 3 ratings were adopted: ○: layer entirely impenetrable when pricked by needle; Δ: layer slightly penetrable by needle; X: layer easily penetrable by needle. Further, for the purpose of examining the interior hardenability, the hardened layer was cut into halves, and the hardened state of the central portion of the layer was examined visually and by touch. For the evaluation of the interior hardenability, 3 ratings were adopted: ○: layer entirely impenetrable when pricked by needle; Δ: layer slightly penetrable by needle; X : layer easily penetrable by needle. Moreover, in Example 1, 1 g of a methacrylic acid/benzyl methacrylate copolymer (at a molar ratio of 7:3) was added in addition to the polymer P-1. The results are shown in Table 1. From the results shown in Table 1, it can be seen that the heat-hardenable compositions containing the sulfonic acid ester compounds of these examples have excellent hardenability, in which not only the layer surface but also the layer interior can be hardened by heating in a relatively short time.

TABLE 1

| Example | Sulfonic acid ester compound | Heating time (in minutes) | Surface hardenability | Interior hardenability |
|---|---|---|---|---|
| 1 | [P-1] | 1.0 | ○ | ○ |
| 2 | [CP-1] | 1.0 | ○ | ○ |
| 3 | [CP-2] | 0.5 | ○ | ○ |
| 4 | [CP-3] | 1.0 | ○ | ○ |
| 5 | [CP-4] | 0.5 | ○ | ○ |
| 6 | [CP-5] | 1.0 | ○ | ○ |
| 7 | [CP-6] | 0.5 | ○ | ○ |
| 8 | [CP-7] | 0.5 | ○ | ○ |
| 9 | [CP-9] | 1.0 | ○ | ○ |

Example 10

A solution was prepared from 2.0 g of the sulfonic acid ester compound [P-1] which had a high molecular weight and was synthesized as described above, 1 g of a methacrylic acid/benzyl methacrylate copolymer (at a molar ratio of 7:3), 2.0 g of 1-methoxy-2-propanol, 2.0 g of methyl ethyl ketone, and 0.01 g of Victoria Pure Blue. The solution was coated on a corona-treated PET film using a No.10 rod bar, and the coating layer was dried at 100° C. for 1 minute. An image was printed on the layer using a thermal head (using a printer as an accessory to an Oasis word processor manufactured by Fujitsu Ltd.). The printed layer was immersed in acetone for 1 minute. In this way, a distinct blue image was obtained. On the other hand, prior to printing, the layer prepared in the above-described way was stored for 3 days in a thermostat-controlled cabinet kept at 45° C. and 75% relative humidity. An image was then printed on the layer after the storage period by using the same thermal head as the case in which printing was carried out on the layer immediately after coating. The image formed on the layer after the storage period was as distinct as the image on the layer image-recorded immediately after being coated.

Examples 11 to 18

Coated layers were prepared by repeating the procedure of Example 10, except that the sulfonic acid ester compound [P-1] having a high molecular weight was replaced with the sulfonic acid ester compounds [CP-1] to [CP-7], and [CP-9], respectively, and that the methacrylic acid/benzyl methacrylate copolymer (at a molar ratio of 7:3) was not used. An image was printed on each of the layers using a thermal head (using a printer as an accessory to an Oasis word processor manufactured by Fujitsu Ltd.). The printed layers were immersed in acetone for 1 minute. In this way, distinct blue images were obtained. On the other hand, prior to printing, the layers prepared in the above-described way were stored for 3 days in a thermostat-controlled cabinet kept at 45° C. and 75% relative humidity. An image was then printed on each of the layers after the storage period using the same thermal head as the case in which printing was carried out on the layer immediately after coating. All of the images formed on the layers after the storage period were as distinct as the images on the layers image-recorded immediately after being coated.

From the results of Examples 10 to 18, it can be seen that distinct images can be printed on the image recording materials, which use the heat-hardenable compositions containing sulfonic acid ester compounds of these examples, by using the thermal head of a commercially available word processor. It can also be seen that the performance of the image recording materials is not deteriorated after being subjected to a storing test in a harsh condition of high temperature and high humidity, and therefore distinct images can still be obtained by printing even after the accelerated storage period.

Examples 19 to 25

A 0.30 mm thick aluminum plate (type of material: 1050) was cleaned and degreased with trichloroethylene and grained with a nylon brush using an aqueous suspension of 400 mesh pumice powder. After being well rinsed with water, the aluminum plate was etched by a process comprising the steps of immersing the aluminum plate in a 25% aqueous solution of sodium hydroxide at 45° C. for 9 seconds, rinsing the aluminum plate with water, immersing the aluminum plate in a 2% aqueous solution of $HNO_3$ for 20 seconds, and rinsing the aluminum plate with water. In the process, the etched amount of the grained aluminum plate was about 3 g/m$^2$. After the process, the aluminum plate was subjected to an anodizing process comprising immersing the aluminum plate in a 7% $H_2SO_4$ electrolyte solution through which a d.c. current with a density of 15A g/dm$^2$ was passed. This process produced an anodized film of 3 g/m$^2$. Then, the surface-treated aluminum plate was rinsed with water and thereafter dried. The aluminum plate was then coated with a subbing composition given below, and the coating was dried at 80° C. for 30 seconds. After drying, the coated amount was 10 mg/m$^2$.

[Subbing Composition]

| | |
|---|---|
| β-alanine | 0.1 g |
| phenylphosphonic acid | 0.05 g |
| methanol | 40 g |
| pure water | 60 g |

Seven solutions were prepared according to the formulation of Solution [A] given below but each changing the type of the sulfonic acid ester compound therein as shown in Table 2. Each of these solutions was coated on the subbing layer of the aluminum plate, and the coating layer was dried at 100° C. for 1 minute. In this way, negative-type planographic form plates [α-1] to [α-7] were obtained. After drying, the coated amount was 1.4 g/m$^2$.

TABLE 2

| Example | Planographic form plate | Sulfonic acid ester compound | Amount of energy required for recording | Difference between amounts of required energy |
|---|---|---|---|---|
| 19 | [α-1] | [CP-1] | 165 mJ/cm$^2$ | 10 mJ/cm$^2$ |
| 20 | [α-2] | [CP-2] | 170 mJ/cm$^2$ | 5 mJ/cm$^2$ |
| 21 | [α-3] | [CP-3] | 160 mJ/cm$^2$ | 15 mJ/cm$^2$ |
| 22 | [α-4] | [CP-4] | 180 mJ/cm$^2$ | 10 mJ/cm$^2$ |
| 23 | [α-5] | [CP-5] | 160 mJ/cm$^2$ | 15 mJ/cm$^2$ |

TABLE 2-continued

| Example | Planographic form plate | Sulfonic acid ester compound | Amount of energy required for recording | Difference between amounts of required energy |
|---|---|---|---|---|
| 24 | [α-6] | [CP-6] | 155 mJ/cm$^2$ | 20 mJ/cm$^2$ |
| 25 | [α-7] | [CP-7] | 150 mJ/cm$^2$ | 20 mJ/cm$^2$ |

Solution [A] in grams

| | |
|---|---|
| Sulfonic acid ester compound | 0.5 |
| Binder polymer | 1.5 |
| Infrared light absorbing agent [IK-1] | 0.1 |
| Coloring agent (AIZEN SPILON BLUE C-RH (manufactured by Hodogaya Chemical Co., Ltd.) | 0.015 |
| Fluorine-containing surfactant (Megafac F-177, manufactured by Dainippon Ink and Chemicals Inc.) | 0.06 |
| Methyl ethyl ketone | 15 |
| Methyl alcohol | 7 |

The structure of the infrared light absorbing agent [IK-1] given below. The binder polymer used in the example was Maruka Linker M S-4P (manufactured by Maruzen Petrochemical Co., Ltd.).

[IK-1]

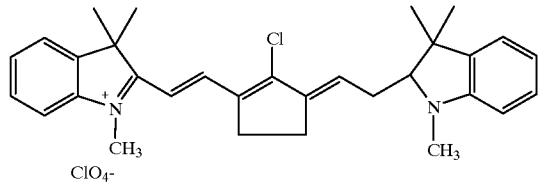

The resulting negative-type planographic form plates were exposed to a scanning beam of a semiconductor laser emitting infrared rays in the wavelength range of from about 830 to 850 nm. After the exposure, the exposed plates were thermally treated at 110° C. for 15 seconds by means of a panel heater and then processed with a developing solution DP-4 manufactured by Fuji Film Co., Ltd. (by dilution with water at a ratio of 1:8). Based on the line width of the image obtained, laser output power, loss in the optical system, and scanning speed, the amount of energy required for recording was calculated.

In order to examine the storage stability, the planographic form plates prior to laser exposure were stored in a condition of high temperature and high humidity (75% relative humidity and 45° C.) for 3 days. After the storage, the plates were exposed to the laser and developed in the above-described way, and the amount of energy required for recording was calculated. In this way, the difference between the amounts of energy required before and after the storage was examined. A planographic form plate, which exhibits a difference of 20 mJ/cm$^2$ or less, is adjudged to be desirable from the standpoint of production and to have good storage stability. These results are all shown in Table 2.

As seen in Table 2, all of the planographic form plates of the above-described examples had a high sensitivity, and images could be recorded on these plates by an energy amount of 200 mJ/cm$^2$ or less. In addition, all of the planographic form plates of the examples had excellent storage stability, and the above-mentioned difference between energy amounts required for recording was not more than 20 mJ/cm$^2$ even after the storage period in harsh conditions of high temperature and high humidity.

As a conclusion, these examples provide a heat-hardenable composition having excellent storage stability. The use of the heat-hardenable composition of the present invention provides an image recording material and a planographic form plate having excellent storage stability. Further, the present invention provides novel, useful sulfonic acid ester compounds.

What is claimed is:

1. A heat-hardenable composition comprising a compound having two or more sulfonic acid ester groups each capable of releasing sulfonic acid by the action of heat and containing the structure represented by the following general formula (1):

General formula (1)

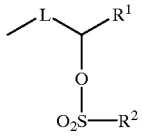

where L represents an organic group comprising polyvalent non-metallic atoms which is necessary for linking the structure represented by the general formula (1) to a polymer skeleton; and $R^1$ and $R^2$ each represent a substituted or unsubstituted alkyl group or a substituted or unsubstituted aryl group.

2. A heat-hardenable composition according to claim 1, wherein the compound having two or more sulfonic acid ester groups each capable of releasing sulfonic acid by the action of heat has an alkali-soluble group in addition thereto.

3. A heat-hardenable composition according to claim 1 which further contains a substance capable of converting light to heat.

4. A heat-hardenable composition according to claim 1, wherein the compound having two or more sulfonic acid ester groups each capable of releasing sulfonic acid by the action of heat is a sulfonic acid ester compound containing the structure represented by the following general formula (2):

General formula (2)

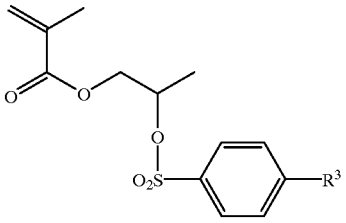

where $R^3$ represents a hydrogen atom, a chlorine atom, a methyl group, a methoxy group, or an acetoamide group.

5. A heat-hardenable composition according to claim 1, wherein the compound having two or more sulfonic acid ester groups is formed by polymerizing a monomer having the structure represented by the general formula (1).

6. A heat-hardenable composition comprising a compound having two or more sulfonic acid ester groups each capable of releasing sulfonic acid by the action of heat and a compound having two or more groups each reactive with the group generated by the thermal release of sulfonic acid wherein the compound having two or more sulfonic acid ester groups each capable of releasing sulfonic acid by the action of heat contains the structure represented by the following general formula (1):

General formula (1)

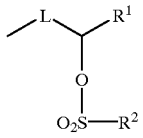

where L represents an organic group comprising polyvalent non-metallic atoms which is necessary for linking the structure represented by the general formula (1) to a polymer skeleton; and $R^1$ and $R^2$ each represent a substituted or unsubstituted alkyl group or a substituted or unsubstitued aryl group.

7. A heat-hardenable composition according to claim 6, wherein the group reactive with the group generated by the thermal release of sulfonic acid is a functional group selected from the group consisting of the hydroxyl group, the carbonxyl group, the amino group, the amido group, and the sulfonamide group.

8. A heat-hardenable composition according to claim 6, wherein the compound having two or more sulfonic acid ester groups each capable of releasing sulfonic acid by the action of heat has an alkali-soluble group in addition thereto.

9. A heat-hardenable composition according to claim 6 which further contains a substance capable of converting light to heat.

10. A heat-hardenable composition according to claim 6, wherein the compound having two or more sulfonic acid ester groups each capable of releasing sulfonic acid by the action of heat is a sulfonic acid ester compound containing the structure represented by the following general formula (2):

General formula (2)

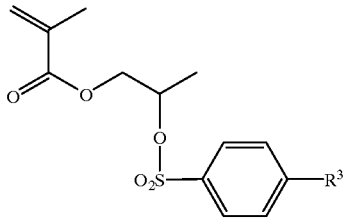

where $R^3$ represents a hydrogen atom, a chlorine atom, a methyl group, a methoxy group, or an acetoamide group.

11. A heat-hardenable composition according to claim 6, wherein the compound having two or more sulfonic acid ester groups is formed by polymerizing a monomer having the structure represented by the general formula (1).

12. A planographic form plate comprising a substrate and an infrared light-sensitive layer which is provided on said substrate and composed of the heat-hardenable composition described in claim 6.

13. A heat-hardenable composition comprising a compound having two or more sulfonic acid ester groups each capable of releasing sulfonic acid by the action of heat and having two or more groups each reactive with the group generated by the thermal release of sulfonic acid.

14. A heat-hardenable composition according to claim 13, wherein the compound having two or more sulfonic acid ester groups each capable of releasing sulfonic acid by the action of heat contains the structure represented by the following general formula (1):

General formula (1)

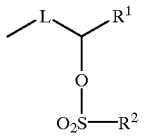

where L represents an organic group comprising polyvalent non-metallic atoms which is necessary for linking the structure represented by the general formula (1) to a polymer skeleton; and $R^1$ and $R^2$ each represent a substituted or unsubstituted alkyl group or a substituted or unsubstituted aryl group.

15. A heat-hardenable composition according to claim 14, wherein the compound, which has two or more sulfonic acid ester groups each capable of releasing sulfonic acid by the action of heat and which has two or more groups each reactive with the group generated by the thermal release of sulfonic acid, is formed by copolymerizing a monomer having a group reactive with the group generated by the thermal release of sulfonic acid with a monomer having the structure represented by the general formula (1).

16. A heat-hardenable composition according to claim 13, wherein the group reactive with the group generated by the thermal release of sulfonic acid is a functional group selected from the group consisting of the hydroxyl group, the carboxyl group, the amino group, the amido group, and the sulfonamide group.

17. A heat-hardenable composition according to claim 13, wherein the compound having two or more sulfonic acid ester groups each capable of releasing sulfonic acid by the action of heat has an alkali-soluble group in addition thereto.

18. A heat-hardenable composition according to claim 13 which further contains a substance capable of converting light to heat.

* * * * *